US006293405B1

(12) United States Patent
Burch, Jr.

(10) Patent No.: US 6,293,405 B1
(45) Date of Patent: Sep. 25, 2001

(54) BILLBOARD PARTITION PANEL

(75) Inventor: William B. Burch, Jr., Marietta, GA (US)

(73) Assignee: RTS Packaging, LLC, Norcross, GA (US)

( * ) Notice: Subject to any disclaimer, the term of this patent is extended or adjusted under 35 U.S.C. 154(b) by 0 days.

(21) Appl. No.: 09/575,956

(22) Filed: May 23, 2000

(51) Int. Cl.[7] ..... B65D 25/00

(52) U.S. Cl. ..... 206/767; 206/730; 206/427

(58) Field of Search ..... 206/427, 730, 206/767; 40/312, 313; 211/72, 132; 248/174

(56) References Cited

U.S. PATENT DOCUMENTS

| | | | |
|---|---|---|---|
| 1,481,333 | | 1/1924 | Agar . |
| 1,968,880 | | 8/1934 | Ebert . |
| 2,964,169 | | 12/1960 | Brachman . |
| 3,123,207 | | 3/1964 | Goldstein . |
| 3,567,014 | | 3/1971 | Feigelman . |
| 3,571,960 | * | 3/1971 | Karel ..... 40/312 |
| 3,640,010 | * | 2/1972 | Altman et al. ..... 40/312 |
| 3,656,611 | | 4/1972 | Mertz . |
| 3,674,133 | | 7/1972 | Locke . |
| 3,757,934 | | 9/1973 | Taub . |
| 3,786,914 | | 1/1974 | Beutler . |
| 3,918,576 | | 11/1975 | Taub . |
| 4,753,341 | | 6/1988 | McIntyre . |
| 4,813,536 | * | 3/1989 | Willis ..... 206/767 |
| 5,251,753 | * | 10/1993 | Pigott et al. ..... 206/386 |
| 5,791,488 | | 8/1998 | Lee . |

* cited by examiner

*Primary Examiner*—David T. Fidei
(74) *Attorney, Agent, or Firm*—Howell & Haferkamp LC

(57) ABSTRACT

A partition assembly is used in a container to divide the container into separate compartments and also as a display for the contents of the container. The partition assembly is comprised of at least one panel that is dimensioned to fit inside and divide the container into separate compartments. The at least one panel has indicia thereon and is adapted to be removed from the container and attached to the top edge of a wall of the container to display the indicia above the container.

20 Claims, 2 Drawing Sheets

BILLBOARD PARTITION PANEL

BACKGROUND OF THE BACKGROUND (i) Field of the Invention

The present invention relates in general to product packaging, and particularly to product packaging that can also be used in constructing a display for the product using the packaging materials. The product packaging serves to partition a container interior into separate compartments to contain a product and can be removed from the container interior and attached to the container to display advertising indicia contained on the packaging materials.

(ii) Description of the Related Art

Partition panels are commonly used in carton packaging, such as cardboard or paperboard boxes, for separating articles packaged in the boxes and preventing the articles from contacting one another when shipped or stored. Partition panels are employed in packaging fragile articles, for example glass articles, such as bottles and other similar articles, and also easily bruised produce items such as fruits and vegetables and in packaging eggs. A typical partition assembly is comprised of several panels arranged in a criss-cross pattern in the interior of the carton. The criss-crossing panels define several separate storage areas in the carton interior. Prior art partition panels typically extend from the bottom to the top of the container and provide added compression strength to the container in addition to separating the container interior into separate storage areas.

A prior art partition assembly is typically comprised of a plurality of rectangular panels of paperboard or cardboard or other similar material. A first set of the panels includes a series of one or more slots extending inward, in a parallel manner, from an edge of each panel and terminating within the panel. A second set of the panels, equal in number to the number of slots on the first set of panels, includes a series of similar slots which cooperate with the series of slots on the first set of panels. The second set of panels are arranged perpendicular to the first set of panels and the slots in each set of panels cooperate by engaging with one another to form a partition assembly. The partition assembly is then inserted into the carton interior to divide the interior into separate areas, each to receive an article to be packaged in the container.

It is common for the carton to also serve as a display for the articles packaged in the carton. Typically, portions of the container are removed along with the partition assembly so that a prospective customer can easily view the articles contained in the carton. The partition assembly that has been removed is usually discarded and serves no further purpose. The singular use and discarding of the partition assembly is a waste of the packaging material, which may be used for other purposes, and is a drawback of prior art partitions.

SUMMARY OF THE INVENTION

The present invention overcomes shortcomings of prior art partition assemblies by providing at least one of the partition panels of the partition assembly with indicia or product information and adapting the one panel to be removed from the partition assembly and attached to the container to display the indicia. The multiple uses of the panels of the partition assembly serves to increase their usefulness and eliminates the necessity of using other materials for constructing a display for the contents of the container.

In the preferred embodiment, the invention is a combined product package and product display and comprises a partition assembly and a container. The container has a bottom surface surrounded by longitudinally opposite front and back walls and laterally opposite left and right walls which together define an interior of the container having a longitudinal length and a lateral width. In use of the invention at least the top surface of the container is removed.

The partition assembly is comprised of at least one panel with the one panel being dimensioned to fit in the interior of the container. The partition assembly, when placed in the interior of the container, divides the interior into separate compartments. The one panel of the partition assembly has indicia thereon and is adapted to be removed from the interior of the container and attached to the container to display the indicia. The one panel could have the indicia on a front surface, on a back surface, or on both surfaces.

In the preferred embodiment, the partition assembly is comprised of a plurality of panels, with the plurality of panels being either longitudinal panels or lateral panels. The longitudinal panels extend across the longitudinal length of the container interior while the lateral panels extend across the lateral width of the container interior. The lateral panels releasably engage with the longitudinal panels to thereby form the plurality of separate compartments in the container interior.

While the panels of the partition assembly can be releasably engaged by a number of different means, preferably the panels contain slots that engage with one another to thereby releasably engage the panels. The longitudinal panels have a first vertical height, longitudinally opposite end edges, vertically opposite top and bottom edges, and a series of slots that extend vertically from the bottom edge toward the top edge. The lateral panels have a second vertical height, laterally opposite end edges, vertically opposite top and bottom edges, and a series of slots that extend vertically from the top edge toward the bottom edge. The slots of the lateral panels are adapted to releasably engage with the slots of the longitudinal panels to thereby form separate compartments in the interior of the container. At least one of the lateral or longitudinal panels has indicia thereon and is adapted to be attached to the container to display the indicia. Additionally, more than one panel of the partition assembly may contain indicia.

The panel containing indicia will releasably attach to a wall of the container by inserting the wall into the vertical slots of the panel. While the panel can be attached to any wall of the container, preferably it is attached to the back wall of the container to thereby display the indicia without obstructing the view of the contents of the container. The method of using the partition panel with the indicia involves removing the top surface of the container, removing the partition assembly from the container, removing the panel with indicia from the partition assembly, and attaching the panel with indicia to the container to display the indicia. Providing the indicia or product information on at least one panel of the partition assembly eliminates the need to use additional material for a display and therefore reduces the overall cost of providing both product packaging and product display material.

BRIEF DESCRIPTION OF THE DRAWINGS

Further objectives and features of the present invention are set forth in the following detailed description of the preferred embodiment of the invention and in the drawing figures wherein.

DETAILED DESCRIPTION OF THE INVENTION

The use of terms such as longitudinal and lateral and top and bottom is for illustration purposes only and is not intended to limit the scope or interpretation of the specification and claims contained herein.

Figure 1:
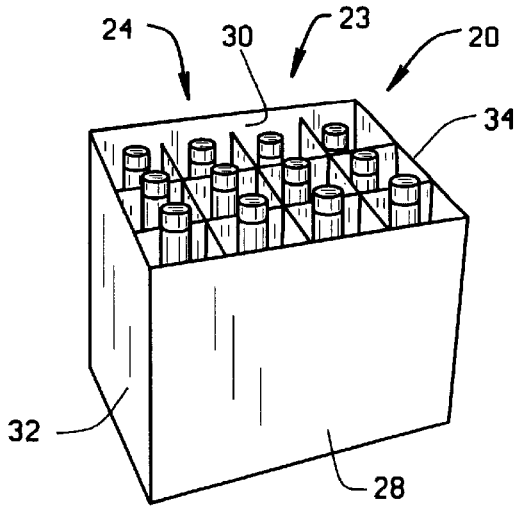
FIG. 1 is an isometric view of a container with a partition assembly of the invention contained therein.
Figure 2:
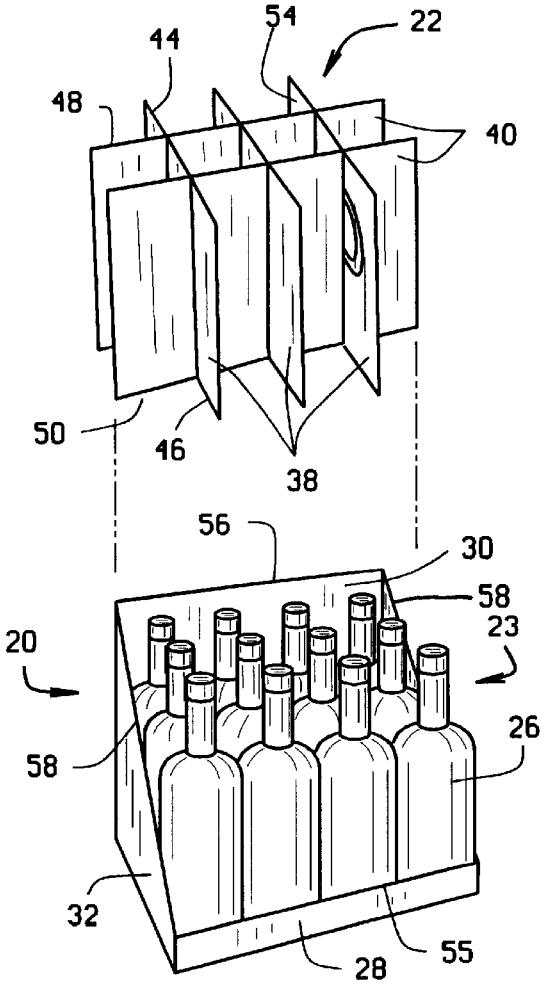
FIG. 2 is an isometric view of the container of FIG. 1 with a portion of the container removed to display the contents of the container and showing the removal of the partition assembly.

FIG. 1 shows a container, generally indicated as 20, which has its top or top surface removed to show a partition assembly 22 that divides the interior 23 of the container 20 into separate compartments 24. The separate compartments 24 contain bottles 26. The use of the container and partition assembly in packaging bottles is only one example of the operative environment of the container and partition assembly and should not be interpreted as limiting the scope of the invention.

The container 20 has longitudinally opposite front and back walls 28,30 and laterally opposite left and right walls 32,34. The container 20 also has a bottom surface (not shown) that is surrounded by the front, back, left and right walls 28,30,32,34. The container 20 is typically made of fiberboard, cardboard, or other material suitable for use as a container. The bottom surface and the front, back, left and right walls 28,30,32,34 define the interior 23 of the container 20.

The partition assembly 22 is preferably made of a plurality of panels. In the drawings, the plurality of panels are depicted as being either longitudinal panels 38 or lateral panels 40. The longitudinal panels 38 are generally parallel to one another and are dimensioned to fit in the interior 23 of the container and extend from the front wall 28 to the back wall 30 when inserted in the interior 23 of the container. The lateral panels 40 are generally parallel to one another and are dimensioned to fit in the interior 23 of the container and extend from the left wall 32 to the right wall 34 when inserted in the interior 23 of the container. The longitudinal panels 38 and the lateral panels 40 are generally perpendicular to one another when assembled together as the partition assembly 22 and when inserted in the interior 23 of the container 20. However, it should be understood that the two sets of panels could have other angular orientations relative to each other.

The longitudinal 38 and lateral 40 panels preferably have a series of vertical slots in the panels to allow the longitudinal 38 and lateral 40 panels to releasably engage with the each other. The longitudinal panels 38 have opposite top 44 and bottom edges 46 and a series of slots 41 that extend from the bottom edge 46 toward the top edge 44. The number of slots 41 in the longitudinal panels 38 is equal to the number of lateral panels 40 that are part of the partition assembly 22. The lateral panels 40 have opposite top 48 and bottom edges 50 and also have a series of slots 42. The slots 42 in the lateral panels 40, however, extend vertically from the top edge 48 toward the bottom edge 50.

The partition assembly 22 is generally constructed in the conventional manner by inserting a longitudinal panel slot 41 through a lateral panel slot 42 while the longitudinal panel 38 and the lateral panel 40 are generally perpendicular to one another. This procedure continues until all of the longitudinal panels 38 and lateral panels 40 are arranged in a generally criss-cross configuration. The slots 41,42 are designed to releasably engage with the panels for the assembly and disassembly of the partition assembly 22. However, it is not necessary for all of the panels of the partition assembly 22 to be removable from the assembly (i.e. be releasably engaged) as the invention can be practiced with only a single panel being removable.

After the partition assembly 22 has been constructed, the partition assembly 22 is inserted into the container 20, thereby forming the separate compartments 24 in the interior 23 of the container 20. The container 20 is now ready to receive the bottles 26 or any other product for which the partition assembly 22 was designed to accommodate. While the container 20 is shown to contain bottles 26, it should be understood that the container 20 and the partition assembly 22 can be configured to contain virtually any product.

Figure 3:
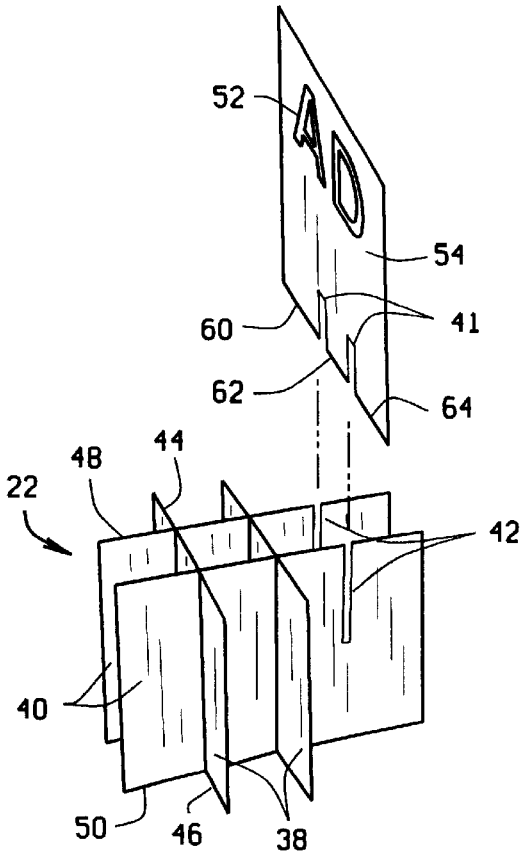
FIG. 3 is an isometric view of the partition assembly showing the removal of one of the panels with the indica contained thereon.

In the preferred embodiment, at least one of the longitudinal panels 38 or lateral panels 40 has indicia or product information 52 on a surface of the panel. In FIG. 3, the panel containing the indicia 52 is indicated by reference numeral 54. While the panel with indicia 54 only shows the indicia on a single side of the panel, it is to be understood that indicia could be included on either side or both sides of the panel 54 without departing from the invention. Additionally, while the partition assembly 22 is shown as having only one panel with indicia 54, it is to be understood that any number of panels of the partition assembly 22 can contain indicia 52.

In the preferred embodiment, the container 20 also serves as a display for the bottles 26 or other products contained in the interior 23. The container 20 is shown as serving as a display by having portions of the left, front, and right walls 32,28,34 removed so that a view of the bottles 26 is not obstructed by the left, front, or right walls 32,28,34. Typically, when the container 20 is serving as a display, the front wall 28 has a top edge 55 that has a vertical height significantly less than the vertical height of a top edge 56 of the back wall 30. The left and right walls have top edges 58 that extend diagonally from the back wall top edge 56 to the front wall top edge 55, thereby enabling a clear view of the products residing within the interior 23 of the container 20. While the container 20 is shown in its preferred embodiment for displaying the products contained therein, it is to be understood that the container 20 can be configured in other arrangements to display the goods contained therein without departing from the scope and intent of the invention.

Figure 4:
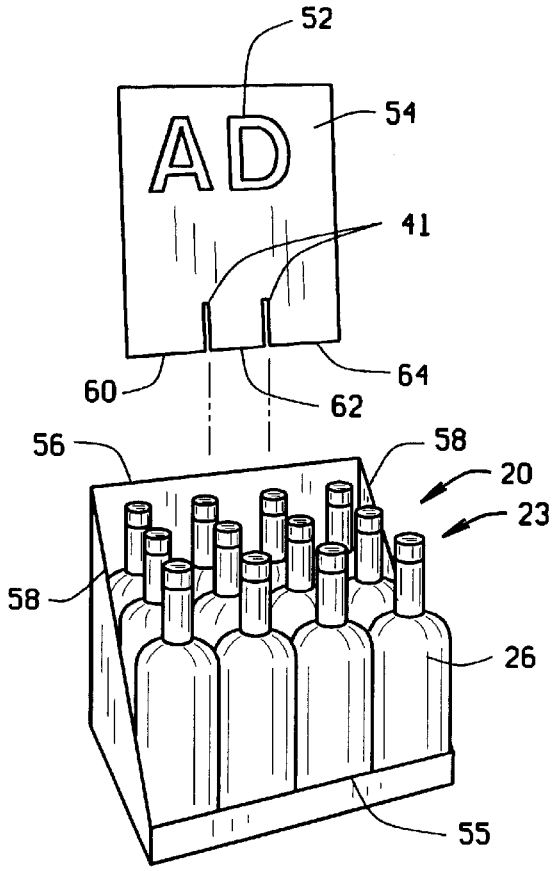
FIG. 4 is an isometric view of the container of FIG. 2 showing a method of attaching the panel with indicia to the container.

In the preferred embodiment as shown in FIG. 4, the panel with indicia 54 is designed to be attached to the back wall 30 of the container 20 to thereby display the indicia 52 on the panel. The panel with indicia 54 is shown as being a longitudinal panel and being attached to the back wall 30 by engaging the slots 41 over the back wall top edge 56. The panel 54 has left 60, middle 62, and right 64 lower edges separated by the two slots 41. When the panel with indicia 54 is attached to the back wall 30 of the container 20, the middle lower edge 62 is behind the back wall 30 while the left and right lower edges 60,64 are in front of the back wall 30 or vice versa. While the panel with indicia 54 is shown as being preferably attached to the back wall 30, it is to be understood that the panel with indicia 54 may be attached to any part of the container 20 without departing from the scope and intention of the invention.

Figure 5:
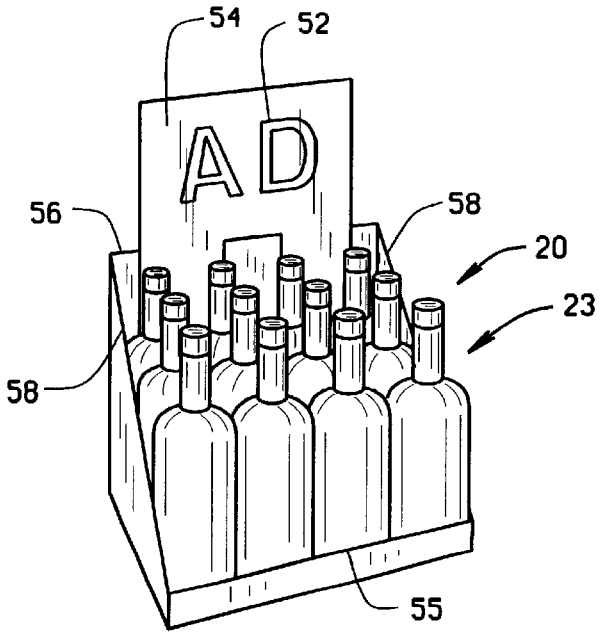
FIG. 5 is an isometric view of the container of FIG. 4 with the panel containing indicia thereon attached to the container.

When the present invention is desired to be utilized as a display for the product contained therein, the partition assembly 22 is removed from the interior 23 of the container 20. The partition assembly 22 is then disassembled by removing the panel with indicia 54 or any other panels containing indicia from the partition assembly 22 as shown in FIG. 3. Then, the container 20 has portions of the front, left and right walls 28,32,34 removed from the container 20 to provide a relatively unobstructed view of the products contained therein. The panel with indicia 54 is then attached to the back wall 30 of the container 20 by engaging the slots 41 with the back wall top edge 56 as shown in FIG. 4. The resulting display is shown in FIG. 5.

As various changes can be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed:

1. A partition assembly for use in a container to divide the container into separate compartments, the partition assembly comprising:

at least one panel dimensioned to fit inside and divide the container into separate compartments, the at least one panel having indicia thereon and being adapted to be removed from the container and attached to the container to display the indicia above the container.

2. The partition assembly of claim 1, wherein:

the at least one panel has opposite front and back surfaces and the indicia is on the front surface.

3. A partition assembly for use in a container to divide the container into separate compartments, the partition assembly comprising:

at least one panel dimensioned to fit inside and divide the container into separate compartments, the at least one panel having indicia thereon and being adapted to be removed from the container and attached to the container to display the indicia above the container;

the partition assembly is comprised of a plurality of panels, the plurality of panels including parallel first panels and parallel second panels, the first and second panels intersect and releasably engage with each other to form a plurality of compartments, and the at least one panel is one of the plurality of panels.

4. The partition assembly of claim 3, wherein:

the first panels have a first vertical height, opposite end edges, vertically opposite top and bottom edges, and a series of slots extending vertically from the bottom edge toward the top edge;

the second panels have a second vertical height, opposite end edges, vertically opposite top and bottom edges, and a series of slots extending vertically from the top edge toward the bottom edge, the slots of the second panels being releasably engaged with the slots of the first panels thereby forming the plurality of compartments; and the at least one panel having indicia thereon is one of the first panels and is adapted to be releasably attached to the container to display the indicia by inserting a wall of the container into the vertical slots of the at least one panel.

5. The partition assembly of claim 4, wherein:

the at least one panel attaches to a back wall of the container to display the indicia thereon.

6. The partition assembly of claim 4, wherein:

the at least one panel is adapted to attach to a top edge of a wall of the container to display the indicia thereon.

7. The partition assembly of claim 1, wherein:

the at least one panel having indicia thereon has at least one slot that is dimensioned to receive a wall of the container to thereby attach the at least one panel to the wall and display the indicia thereon.

8. A combined product package and product display comprising:

a container having an interior with a longitudinal length and a lateral width, the interior being defined by a bottom surface surrounded by longitudinally opposite front and back walls and laterally opposite left and right walls;

a partition comprised of at least one panel, the at least one panel being dimensioned to fit in the interior of the container and when placed in the interior of the container dividing the interior into separate compartments, the at least one panel having indicia thereon and being adapted to be removed from the interior of the container and attached to the container to display the indicia thereon.

9. The combined product package and product display of claim 8, wherein:

the at least one panel having the indicia thereon has a front surface and a back surface, and the front surface has the indicia thereon.

10. A combined product package and product display comprising:

a container having an interior with a longitudinal length and a lateral width, the interior being defined by a bottom surface surrounded by longitudinally opposite front and back walls and laterally opposite left and right walls;

a partition comprised of at least one panel, the at least one panel being dimensioned to fit in the interior of the container and when placed in the interior of the container dividing the interior into separate compartments, the at least one panel having indicia thereon and being adapted to be removed from the interior of the container and attached to the container to display the indicia thereon;

the partition is comprised of a plurality of panels, the plurality of panels include longitudinal panels and lateral panels;

the longitudinal panels extend across the longitudinal length of the container interior;

the lateral panels extend across the lateral width of the container interior and releasably engage with the longitudinal panels thereby forming a plurality of separate compartments in the container interior; and the at least one panel having the indicia thereon is one of the plurality of panels.

11. The combined product package and product display of claim 8, wherein:

the at least one panel having the indicia thereon attaches to at least one of the front, back, left and right walls.

12. The combined product package and product display of claim 8, wherein:

the at least one panel having the indicia thereon has at least one slot dimensioned to receive a wall of the container to thereby attach the at least one panel to the wall and display the indicia thereon.

13. The combined product package and product display of claim 8, wherein:

the container walls have top edges that are opposite the bottom surface and the at least one panel having indicia thereon is adapted to attach to the top edge of at least one of the container walls.

14. A combined product package and product display comprising:

a container having an interior with a longitudinal length and a lateral width, the interior being defined by a bottom surface surrounded by longitudinally opposite front and back walls and laterally opposite left and right walls;

a partition comprised of at least one panel, the at least one panel being dimensioned to fit in the interior of the container and when placed in the interior of the container dividing the interior into separate compartments, the at least one panel having indicia thereon and being adapted to be removed from the interior of the container and attached to the container to display the indicia thereon;

the partition is comprised of a plurality of panels, the plurality of panels being longitudinal panels and lateral panels;

the longitudinal panels extend across the longitudinal length of the container interior and have a first vertical height, longitudinally opposite end edges, vertically opposite top and bottom edges, and a series of slots in the longitudinal panels extending vertically from the bottom edge toward the top edge;

the lateral panels extend across the lateral width of the container interior and have a second vertical height, laterally opposite end edges, vertically opposite top and bottom edges, and a series of slots in the lateral panels extending vertically from the top edge toward the bottom edge, the slots of the lateral panels being releasably engaged with the slots of the longitudinal panels thereby forming the separate compartments in the interior of the container; and the at least one panel having indicia thereon is one of the longitudinal panels and is adapted to be releasably attached to the back wall of the container to display the indicia thereon by inserting the back wall into the vertical slots of the at least one panel.

15. A method of both packaging a product and constructing a display for the product using packaging materials, the method comprising the steps of:

providing a container having an interior with a longitudinal length and a lateral width, the interior being defined by a bottom surface surrounded by longitudinally opposite front and back walls and laterally opposite left and right walls;

providing a partition assembly dimensioned to fit in the interior of the container to separate the container into separate compartments to contain a product, the partition assembly comprising at least one partition panel;

providing the at least one partition panel with indicia thereon;

providing the partition assembly in the container interior thereby separating the container interior into separate compartments to contain a product and protect the product contained therein;

removing the partition assembly from the container interior;

removing the at least one partition panel with indicia thereon from the partition assembly; and attaching the at least one partition panel with indicia thereon to the container to display the indicia thereon.

16. The method of claim 15, further comprising the steps of:

cutting and removing portions of the front, left and right walls of the container to expose the product contained in the container interior prior to the step of attaching the at least one partition panel with indicia thereon to the container.

17. The method of claim 16, further comprising the steps of:

cutting the front wall horizontally from the left wall to the right wall;

cutting the right and left walls diagonally from a top edge of the back wall toward the front wall; and removing the portions of the front, left and right walls above the cuts.

18. The method of claim 15, wherein the step of attaching the at least one partition panel to the container further comprises:

providing the at least one partition panel with at least one slot in a bottom edge of the at least one partition panel, the slot being adapted to attach the at least one partition panel to a wall of the container.

19. The method of claim 15, wherein the step of attaching the at least one partition panel to the container further comprises:

attaching the at least one partition panel to a top edge of the back wall of the container.

20. A partition assembly for use in a container to divide the container into separate compartments, the partition assembly comprising:

at least one panel dimensioned to fit inside and divide the container into separate compartments, the at least one panel having indicia thereon and being adapted to be removed from the container and attached to the container to display the indicia above the container; and the partition assembly is comprised of a plurality of panels, the plurality of panels including a first panel and a second panel, the first and second panels intersect and releasably engage with each other to form a plurality of compartments, and the at least one panel is one of the plurality of panels.

* * * * *